US012690689B2

(12) United States Patent
Chen et al.

(10) Patent No.: US 12,690,689 B2
(45) Date of Patent: Jul. 28, 2026

(54) SELF-LOCKING MECHANISM FOR FOLDING SOFA

(71) Applicant: JIAXING REST FURNITURE & APPLIANCE CO., LTD., Jiaxing (CN)

(72) Inventors: Jiguan Chen, Jiaxing (CN); Bin Chen, Jiaxing (CN); Qiangqiang Wu, Jiaxing (CN); Baoli Zhang, Jiaxing (CN); Chong Ma, Jiaxing (CN)

(73) Assignee: JIAXING REST FURNITURE & APPLIANCE CO., LTD., Jiaxing (CN)

( * ) Notice: Subject to any disclaimer, the term of this patent is extended or adjusted under 35 U.S.C. 154(b) by 0 days.

(21) Appl. No.: 19/026,591

(22) Filed: Jan. 17, 2025

(65) Prior Publication Data

US 2026/0060436 A1 Mar. 5, 2026

(30) Foreign Application Priority Data

Aug. 28, 2024 (CN) ..... 202411186184.5

(51) Int. Cl.
*A47C 17/23* (2006.01)

(52) U.S. Cl.
CPC ..... *A47C 17/23* (2013.01)

(58) Field of Classification Search
CPC ..... A47C 27/04; A47C 27/13; A47C 27/136; A47C 27/138; A47C 27/22; A47C 27/23; A47C 27/40; A47C 27/86
USPC ..... 5/12.1, 16, 17, 22, 31, 32.1, 56
See application file for complete search history.

(56) References Cited

U.S. PATENT DOCUMENTS

| | | | | | |
|---|---|---|---|---|---|
| 981,926 | A * | 1/1911 | Karpen | A47C 7/34 | 5/55.1 |
| 1,504,762 | A * | 8/1924 | Hultgren | A47C 17/22 | 5/21 |
| 1,504,763 | A * | 8/1924 | Hultgren | A47C 17/22 | 5/12.2 |
| 1,547,650 | A * | 7/1925 | Herz | A47C 17/32 | 5/56 |
| 1,650,217 | A * | 11/1927 | Jacobs | A47C 17/32 | 5/56 |
| 1,721,559 | A * | 7/1929 | Herz | A47C 17/32 | 5/56 |
| 1,743,216 | A * | 1/1930 | Honsinger | A47C 17/22 | 5/56 |
| 1,764,875 | A * | 6/1930 | Hultgren | A47C 17/22 | 5/56 |

(Continued)

*Primary Examiner* — David R Hare
(74) *Attorney, Agent, or Firm* — Bayramoglu Law Offices LLC

(57) ABSTRACT

A self-locking mechanism for a folding sofa is provided. The self-locking mechanism includes a link assembly, a self-locking rivet, and a limit rotating rod, where the link assembly includes one end pivoted to a front sofa cushion and the other end pivoted to a fixed base frame of a sofa frame; the front sofa cushion is folded and stored on a rear sofa cushion inside the sofa frame or unfolded at one side of the rear sofa cushion through the linkage of the link assembly; the self-locking rivet is located on the link assembly; the limit rotating rod is movably provided on the front sofa cushion; one end of the limit rotating rod is provided with an arc-shaped hook corresponding to the self-locking rivet; and when the front sofa cushion is unfolded at one side of the rear sofa cushion, the link assembly drives the self-locking rivet to slide.

7 Claims, 9 Drawing Sheets

(56) References Cited

U.S. PATENT DOCUMENTS

| | | | | | |
|---|---|---|---|---|---|
| 1,801,248 | A * | 4/1931 | Shaw | A47C 17/32 | 5/55.1 |
| 1,838,293 | A * | 12/1931 | Basile | A47C 17/32 | 5/56 |
| 1,858,542 | A * | 5/1932 | Duvall | A47C 17/32 | 5/56 |
| 1,907,526 | A * | 5/1933 | Englander | A47C 17/32 | 5/56 |
| 3,178,731 | A * | 4/1965 | Pokorny, Jr. | A47C 17/23 | 5/13 |
| 3,389,409 | A * | 6/1968 | Rogers, Jr. | A47C 17/134 | 5/28 |
| 9,144,319 | B2 * | 9/2015 | Murphy | A47C 17/2076 | |
| 9,468,303 | B2 * | 10/2016 | Garland | A47C 17/1756 | |
| 9,980,572 | B2 * | 5/2018 | Thurow | A47C 17/162 | |
| 10,548,406 | B2 * | 2/2020 | Garland | A47C 17/04 | |
| 11,096,499 | B1 * | 8/2021 | Højfeldt | A47C 17/13 | |
| 12,569,068 | B2 * | 3/2026 | Chen | A47C 17/17 | |
| 2018/0064258 | A1 * | 3/2018 | Murphy | A47C 17/138 | |

* cited by examiner

SELF-LOCKING MECHANISM FOR FOLDING SOFA

CROSS-REFERENCE TO THE RELATED APPLICATIONS

This application is based upon and claims priority to Chinese Patent Application No. 202411186184.5, filed on Aug. 28, 2024, the entire contents of which are incorporated herein by reference.

TECHNICAL FIELD

The present disclosure relates to the technical field of beds, and in particular to a self-locking mechanism for a folding sofa.

BACKGROUND

Modern living arrangements advocate simplicity. With the acceleration of social development and the continuous increase of population, the limitation of living space is becoming increasingly apparent. In this context, multifunctional furniture, for example sofa bed, has gradually become the choice of the public. A sofa bed is a necessity for small houses to meet the needs of occasional overnight guests. Normally, a sofa bed can be placed in the living room or study to provide a seating function. In case there is an overnight guest, the sofa bed is unfolded and covered with bedding, thereby converting the sofa bed into a sleeping bed. Sofa beds are also suitable for ordinary houses, such as one with three bedrooms, one living room, and one dining room, to help the host cope with occasional visits from more than one overnight guest in addition to the guest bed. Currently, there are various types of sofa beds on the market, with various ways, such as folding, flipping, and extension, to convert sofa beds between sofas and beds. These sofa beds use various connection mechanisms, which are usually time-consuming, strenuous, and inconvenient. In addition, due to the lack of a locking structure for the conversion between the sofa and bed, the sofa bed is easily unstable when being unfolded.

SUMMARY

In order to solve the above technical problems, an embodiment of the present disclosure provides a self-locking mechanism for a folding sofa. Specifically, the present disclosure adopts the following technical solution.

A self-locking mechanism for a folding sofa includes a link assembly, a self-locking rivet, and a limit rotating rod, where the link assembly includes one end pivoted to a front sofa cushion and the other end pivoted to a fixed base frame of a sofa frame; the front sofa cushion is folded and stored on a rear sofa cushion inside the sofa frame or unfolded at one side of the rear sofa cushion through the linkage of the link assembly; the self-locking rivet is located on the link assembly; the limit rotating rod is movably provided on the front sofa cushion; one end of the limit rotating rod is provided with an arc-shaped hook corresponding to the self-locking rivet; and when the front sofa cushion is unfolded at one side of the rear sofa cushion, the link assembly drives the self-locking rivet to slide into the arc-shaped hook through an opening of the arc-shaped hook, and the limit rotating rod cooperates with the self-locking rivet to prevent the link assembly from rotating.

In an embodiment, the link assembly includes a first link and a second link; the first link is provided with a first link segment; the first link segment includes one end pivoted to a lower side of the front sofa cushion and the other end pivoted to the fixed base frame; the second link is provided with a second link segment and a third link segment located at one end of the second link segment; the second link segment corresponds to and is parallel to the first link segment; one end of the second link segment is pivoted to the lower side of the front sofa cushion; a connecting end between the second link segment and the third link segment is pivoted to the fixed base frame; the third link segment is pivoted to a lower side of the rear sofa cushion; and when the front sofa cushion is folded and stored on the rear sofa cushion or unfolded at one side of the rear sofa cushion through the linkage of the link assembly, the third link segment drives the rear sofa cushion to fall or rise.

In one embodiment, the self-locking mechanism for a folding sofa further includes a first elastic member; one end of the first elastic member is pivoted to the fixed base frame; the first link is further provided with a fourth link segment located at a pivot end of the first link segment pivoted to the fixed base frame; the fourth link segment corresponds to and is parallel to the third link segment; the other end of the first elastic member is pivoted to the fourth link segment; and when the front sofa cushion is unfolded at one side of the rear sofa cushion, the first elastic member is in an extended state.

In an embodiment, the lower side of the front sofa cushion is provided with a first connecting member; the first link segment and the second link segment are pivoted to the first connecting member; the lower side of the rear sofa cushion is provided with a second connecting member; and the third link segment is pivoted to the second connecting member.

In an embodiment, the limit rotating rod is provided with a first end, a second end opposite to the first end, and a middle segment located between the first end and the second end; the arc-shaped hook is located at the first end; the middle segment is pivoted to the first connecting member; and the limit rotating rod is configured to rotate around a pivot position thereof so as to slide the self-locking rivet out of the arc-shaped hook.

In an embodiment, the first connecting member is provided with an arc-shaped groove corresponding to the limit rotating rod; a side of the limit rotating rod is provided with a rotating tab; the rotating tab is located inside the arc-shaped groove; when the front sofa cushion is unfolded at one side of the rear sofa cushion through the link assembly, the rotating tab abuts against a lower end of the arc-shaped groove; and when the rotating tab slides upward along the arc-shaped groove, the rotating tab drives the limit rotating rod to rotate around the pivot position thereof, causing the self-locking rivet to slide out of the arc-shaped hook.

In an embodiment, the self-locking mechanism for a folding sofa further includes a second elastic member; the second elastic member includes one end connected to the first end of the limit rotating rod and the other end connected to the first connecting member; and when the rotating tab slides upward along the arc-shaped groove to abut against an upper end of the arc-shaped groove, the second elastic member prevents the limit rotating rod from rotating due to gravity thereof.

In an embodiment, when the front sofa cushion is folded and stored on the rear sofa cushion through the linkage of the link assembly, the second link pushes the rotating tab, causing the rotating tab to slide downward along the arc-shaped groove, and the second elastic member drives the limit rotating rod to reset.

In an embodiment, the limit rotating rod is located between the first link segment and the second link segment; the arc-shaped groove is located at one side of the limit rotating rod close to the second link segment; an arc center of the arc-shaped groove faces the pivot position of the limit rotating rod; and the second elastic member is connected to an end of the first connecting member close to the arc-shaped groove.

In an embodiment, a side of the front sofa cushion away from the rear sofa cushion is provided with a support plate; and when the front sofa cushion is folded and stored on the rear sofa cushion, the support plate is fitted to an outer surface of the sofa frame.

In the embodiment of the present disclosure, when the front sofa cushion is folded and stored on the rear sofa cushion inside the sofa frame or unfolded at one side of the rear sofa cushion through the linkage of the link assembly, the folding sofa can be unfolded or folded in one step, with simple operation and small structural volume, reducing logistics costs. After the front sofa cushion is unfolded, the limit rotating rod cooperates with the self-locking rivet to prevent the link assembly from rotating, thereby locking the folding sofa. In this way, the front sofa cushion cannot be folded due to excessive load of the rear sofa cushion, greatly improving product safety. In addition, in the present disclosure, there is no gap in an exposed part of an iron frame mechanism of the self-locking mechanism for a folding sofa, avoiding various unexpected pinch accidents.

BRIEF DESCRIPTION OF THE DRAWINGS

The drawings described herein are provided for further understanding of the present disclosure, and constitute a part of the present disclosure. The exemplary embodiments of this application and illustrations thereof are intended to explain the present disclosure, but do not constitute inappropriate limitations to the present disclosure. Figures.

DETAILED DESCRIPTION OF THE EMBODIMENTS

The technical solutions in the embodiments of the present disclosure are clearly and completely described below with reference to the drawings in the embodiments of the present disclosure. Apparently, the described embodiments are merely some rather than all of the embodiments of the present disclosure. All other embodiments obtained by those of ordinary skill in the art based on the embodiments of the present disclosure without creative efforts should fall within the protection scope of the present disclosure.

In addition, terms such as "first" and "second" used herein are not intended to specifically refer to order or sequence or to limit the scope of the present disclosure. Instead, they are only intended to distinguish components or operations described using the same technical terms.

Figure 1:
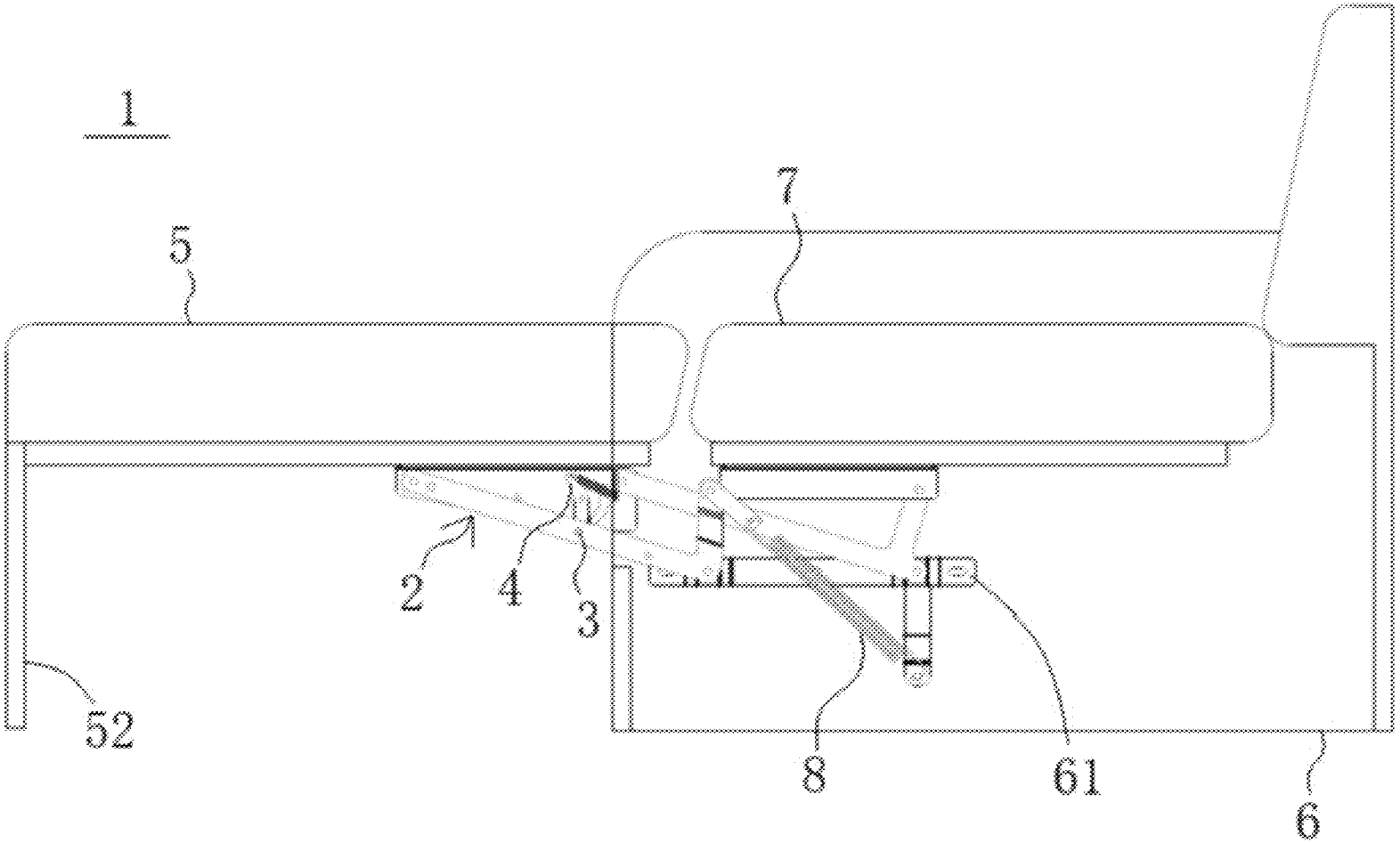
FIG. 1 is a perspective view of a folding sofa in an unfolded state according to the present disclosure.
Figure 2:
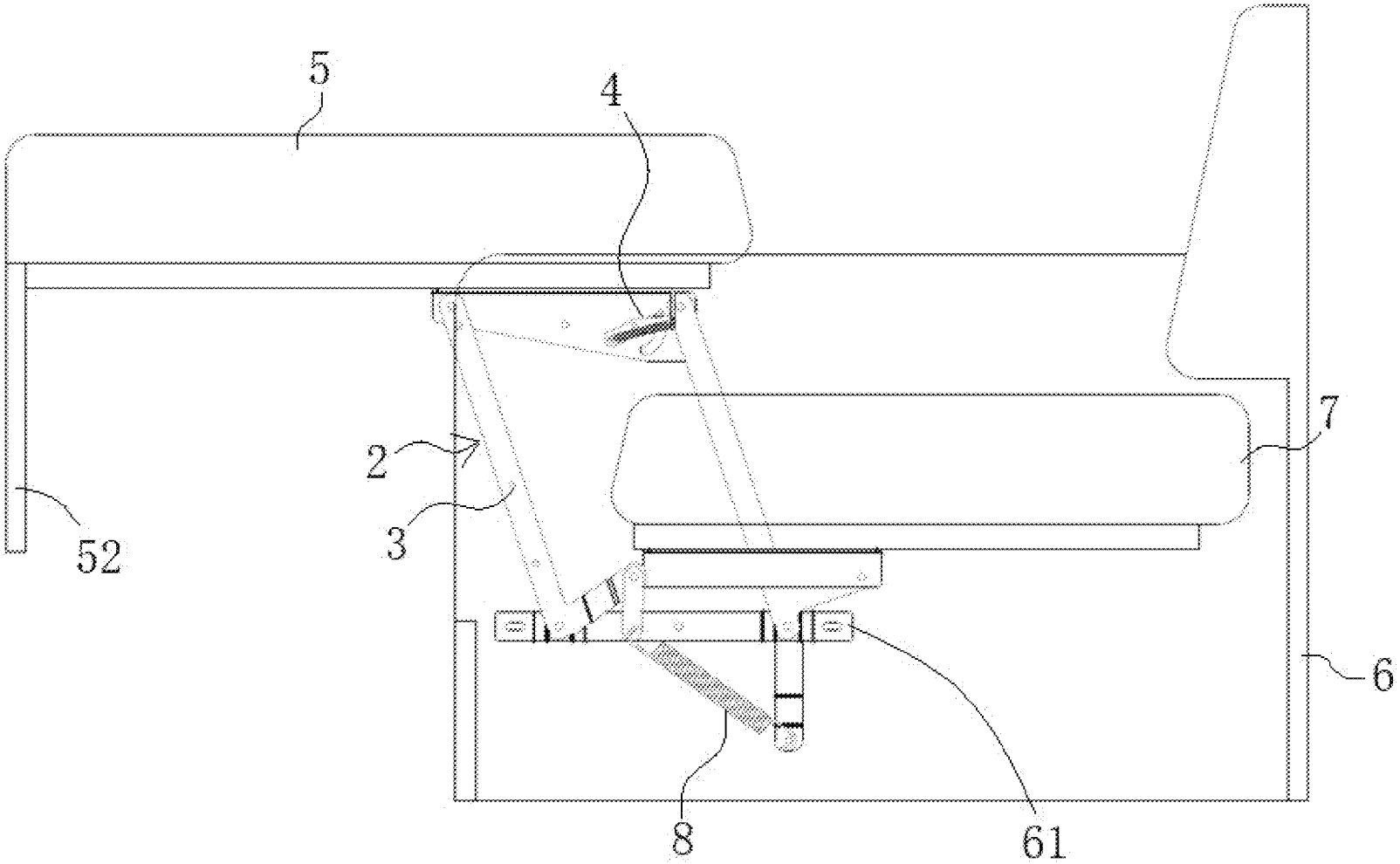
FIG. 2 is a perspective view of the folding sofa in a storage process according to the present disclosure.
Figure 3:
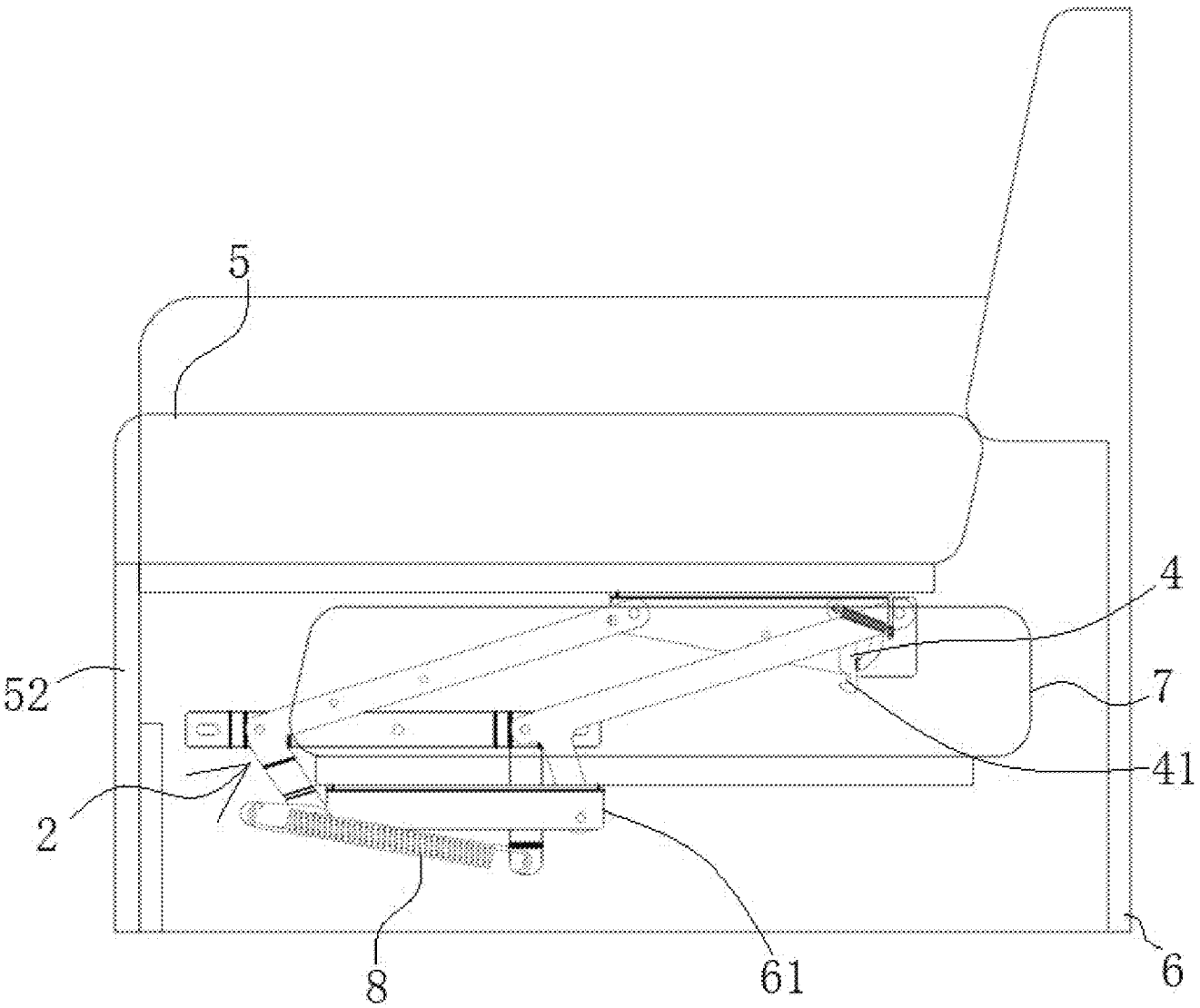
FIG. 3 is a perspective view of the folding sofa in a stored state according to the present disclosure.

FIG. 1 is a perspective view of a folding sofa in an unfolded state according to the present disclosure, FIG. 2 is a perspective view of the folding sofa in a storage process, and FIG. 3 is a perspective view of the folding sofa in a stored state. As shown in FIGS. 1 to 3, in this implementation, self-locking mechanism 1 for a folding sofa includes link assembly 2, self-locking rivet 3, and limit rotating rod 4. One end of the link assembly 2 is pivoted to front sofa cushion 5, and the other end of the link assembly 2 is pivoted to fixed base frame 61 of sofa frame 6. After the front sofa cushion 5 is folded and stored on rear sofa cushion 7 inside the sofa frame 6 through the linkage of the link assembly 2, as shown in FIG. 3, the front sofa cushion 5 is stacked on the rear sofa cushion 7. After the front sofa cushion 5 is unfolded at one side of the rear sofa cushion 7 through the linkage of the link assembly 2, as shown in FIG. 1, the front sofa cushion 5 is unfolded at a left side of the sofa cushion 7, and the front sofa cushion 5 and the sofa cushion 7 form a mattress.

Figure 4:
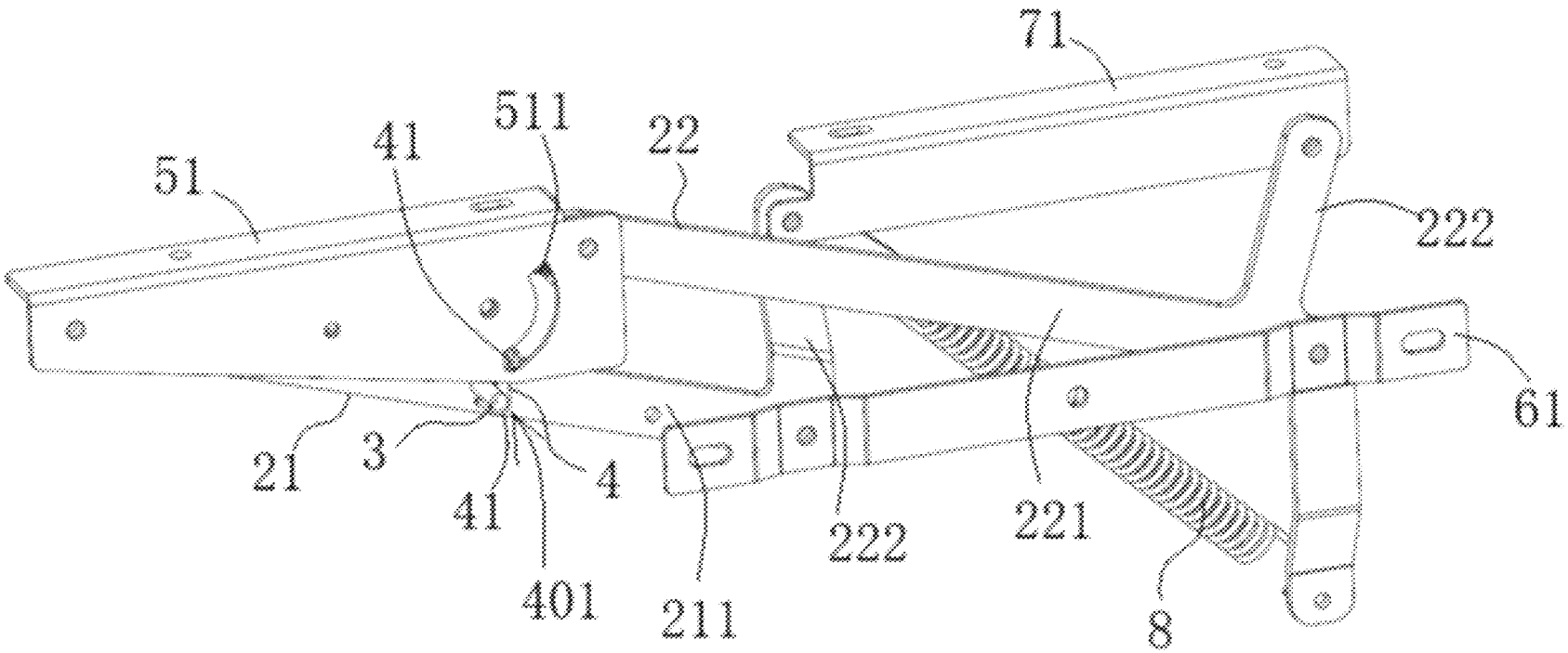
FIG. 4 is a perspective view of a self-locking mechanism in a self-locking state according to the present disclosure.
Figure 5:
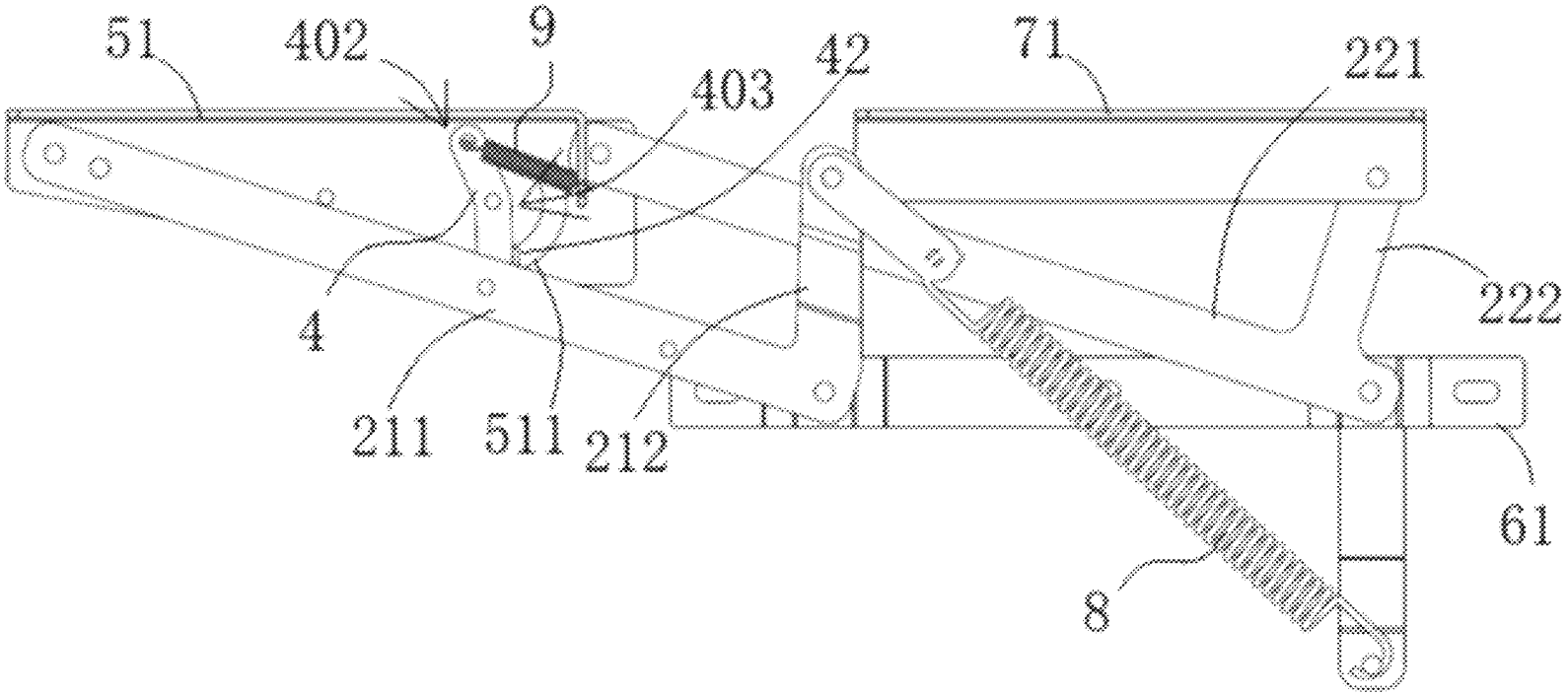
FIG. 5 is a side view of the self-locking mechanism shown in FIG. 4.

FIG. 4 is a perspective view of the self-locking mechanism in a self-locking state according to the present disclosure, and FIG. 5 is a side view of the self-locking mechanism shown in FIG. 4. As shown in FIGS. 4, 5, and 1, on the above basis, the self-locking rivet 3 is located on the link assembly 2. The limit rotating rod 4 is movably provided below the front sofa cushion 5. The movably providing here means that the limit rotating rod 4 is rotatable on the front sofa cushion 5. One end of the limit rotating rod 4 is provided with arc-shaped hook 41 corresponding to the self-locking rivet 3. When the front sofa cushion 5 is unfolded at one side of the rear sofa cushion 7, the link assembly 2 drives the self-locking rivet 3 to slide into the arc-shaped hook 41 through an opening of the arc-shaped hook 41, and the limit rotating rod 4 cooperates with the self-locking rivet 3 to prevent the link assembly 2 from rotating. In this way, the front sofa cushion 5 cannot be folded and stored inside the fixed base frame 6 through the linkage of the link assembly 2, thereby locking the self-locking mechanism 1 for a folding sofa.

As shown in FIGS. 1 to 5, in this implementation, when the self-locking mechanism 1 for a folding sofa is in use, the front sofa cushion 5 is folded and stored on the rear sofa cushion 7 inside the fixed base frame 6 or unfolded at one side of the rear sofa cushion 7 through the linkage of the link assembly 2. In this way, the self-locking mechanism 1 for a folding sofa can be unfolded or folded in one step, with simple operation and small structural volume, reducing logistics costs. After the front sofa cushion 5 is unfolded, the limit rotating rod 4 cooperates with the self-locking rivet 3 to prevent the link assembly 2 from rotating, thereby locking the self-locking mechanism 1 for a folding sofa. In this way, the front sofa cushion 5 cannot be folded due to excessive load of the rear sofa cushion 7, greatly improving product safety. In this implementation, there is no gap in an exposed part of an iron frame mechanism of the self-locking mechanism 1 for a folding sofa, avoiding various unexpected pinch accidents.

The following provides a detailed explanation of the structure of the self-locking mechanism 1 for a folding sofa in this implementation. As shown in FIGS. 4 and 5, the link assembly 2 includes first link 21 and second link 22. The first link 21 is provided with first link segment 211. One end of the first link segment 211 is pivoted to a lower side of the front sofa cushion 5, and the other end of the first link segment 211 is pivoted to the fixed base frame 61. The second link 22 is provided with second link segment 221 and third link segment 222 located at one end of the second link segment 221. The second link segment 221 corresponds to and is parallel to the first link segment 211, as shown in FIG. 4. The first link segment 211 is located at a left side of the second link segment 221. One end of the second link segment 221 is pivoted to the lower side of the front sofa cushion 5. A connecting end between the second link segment 221 and the third link segment 222 is pivoted to the fixed base frame 61. The third link segment 222 is pivoted to a lower side of the rear sofa cushion 7. When the front sofa cushion 5 is folded and stored on the rear sofa cushion 7 or unfolded at one side of the rear sofa cushion 7 through the linkage of the link assembly 2, the third link segment 222 drives the rear sofa cushion 7 to fall or rise.

On the above basis, the first link 21 is further provided with fourth link segment 212 located at a pivot end of the first link segment 211 pivoted to the fixed base frame 61. The fourth link segment 212 corresponds to and is parallel to the third link segment 222. The self-locking mechanism 1 for a folding sofa further includes first elastic member 8. One end of the first elastic member 8 is pivoted to the fixed base frame 61. As shown in FIG. 5, a pivot position of the first elastic member 8 pivoted to the fixed base frame 61 is located below a pivot position of the second link 22 pivoted to the fixed base frame 61. The other end of the first elastic member 8 is pivoted to the fourth link segment 212. When the front sofa cushion 5 is unfolded at one side of the rear sofa cushion 7, the first elastic member 8 is in an extended state. In this way, during the folding and storage process of the front sofa cushion 5, as shown in FIGS. 1 to 3, the first elastic member 8 gradually resets so as to provide assistance to the front sofa cushion 5, making the product easier to use. The first elastic member 8 can be a spring.

As shown in FIGS. 4 and 5, the lower side of the front sofa cushion 5 is provided with first connecting member 51. The first link segment 211 and the second link segment 221 are pivoted to the first connecting member 51. The first connecting member 51 includes a first angle bar. A horizontal side steel plate of the first angle bar is fixedly connected to the lower side of the front sofa cushion 5. The first link segment 211 and the second link segment 221 are pivoted to a vertical side steel plate of the first angle bar. The lower side of the rear sofa cushion 7 is provided with second connecting member 71. The third link segment 222 is pivoted to the second connecting member 71. The second connecting member 71 includes a second angle bar, and a horizontal side steel plate of the second angle bar is fixedly connected to the lower side of the rear sofa cushion 7. The third link segment 222 is pivoted to a vertical side steel plate of the second angle bar.

Figure 6:
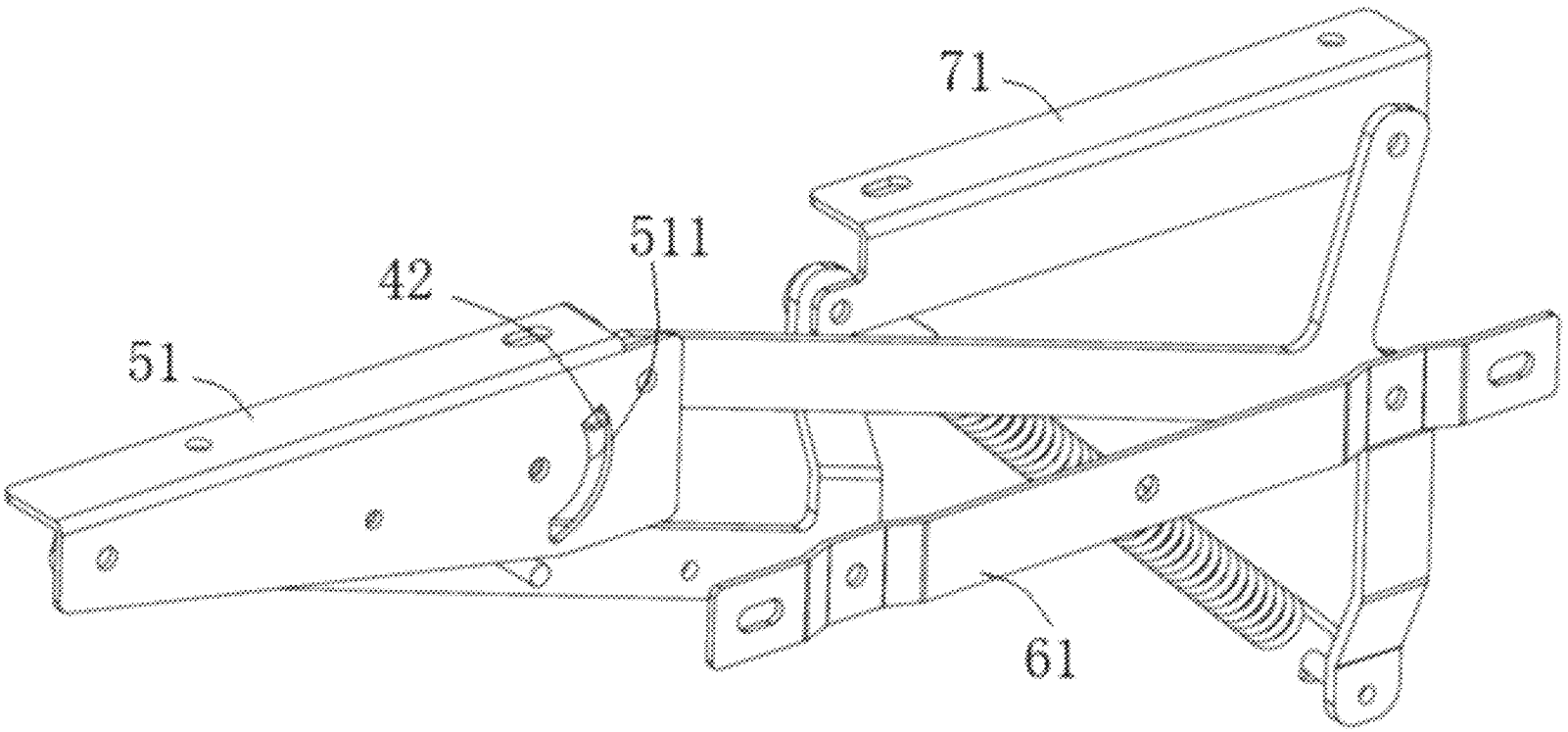
FIG. 6 is a perspective view of the self-locking mechanism in an unlocked state according to the present disclosure.
Figure 7:
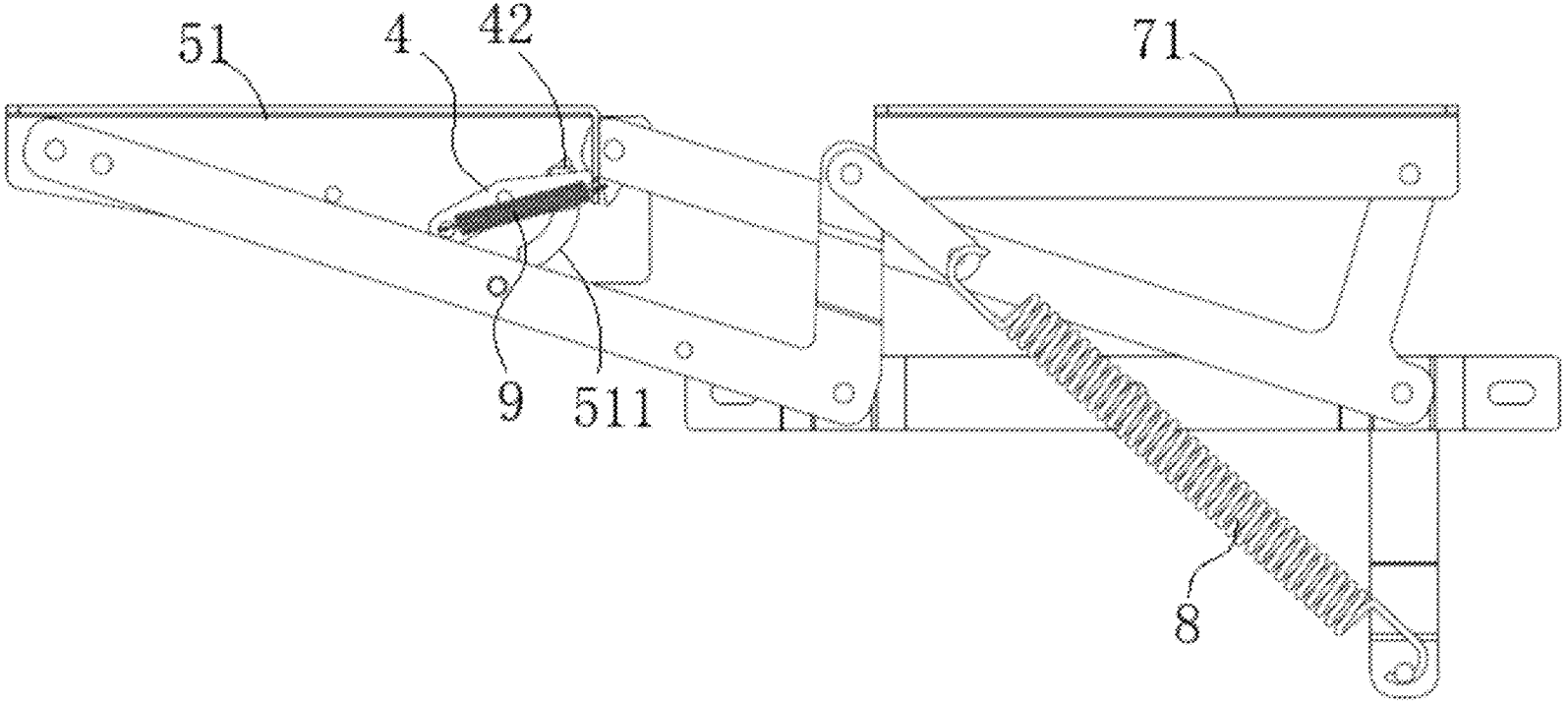
FIG. 7 is a side view of the self-locking mechanism shown in FIG. 6.

FIG. 6 is a perspective view of the self-locking mechanism in an unlocked state according to the present disclosure, and FIG. 7 is a side view of the self-locking mechanism shown in FIG. 6. As shown in FIGS. 6, 7, 4, and 5, the limit rotating rod 4 is provided with first end 401, second end 402 opposite to the first end, and middle segment 403 located between the first end 401 and the second end 402. The arc-shaped hook 41 is located at the first end 401. The middle segment 403 is pivoted to the first connecting member 51. In this implementation, the middle segment 403 of the limit rotating rod 4 is pivoted between the first link segment 211 and the second link segment 221 that are pivoted to the vertical side steel plate of the first angle bar. The limit rotating rod 4 is configured to rotate around a pivot position thereof so as to slide the self-locking rivet 3 out of the arc-shaped hook 41, thereby unlocking the self-locking mechanism 1 for a folding sofa. The front sofa cushion 5 can be folded and stored inside the fixed base frame 6 again through the linkage of the link assembly 2. Furthermore, the first connecting member 51 is provided with arc-shaped groove 511 corresponding to the limit rotating rod 4. In this implementation, the arc-shaped groove 511 is located at one side of the limit rotating rod 4 close to the second link segment 221, and an arc center of the arc-shaped groove 511 faces the pivot position of the limit rotating rod 4. A side of the limit rotating rod 4 is provided with rotating tab 42. The rotating tab 42 is located inside the arc-shaped groove 511. When the front sofa cushion 5 is unfolded at one side of the rear sofa cushion 7 through the link assembly 2, the rotating tab 42 abuts against a lower end of the arc-shaped groove 511. When the rotating tab 42 slides upward along the arc-shaped groove 511, the rotating tab 42 drives the limit rotating rod 4 to rotate around the pivot position thereof, causing the self-locking rivet 3 to slide out of the arc-shaped hook 41.

Figure 8:
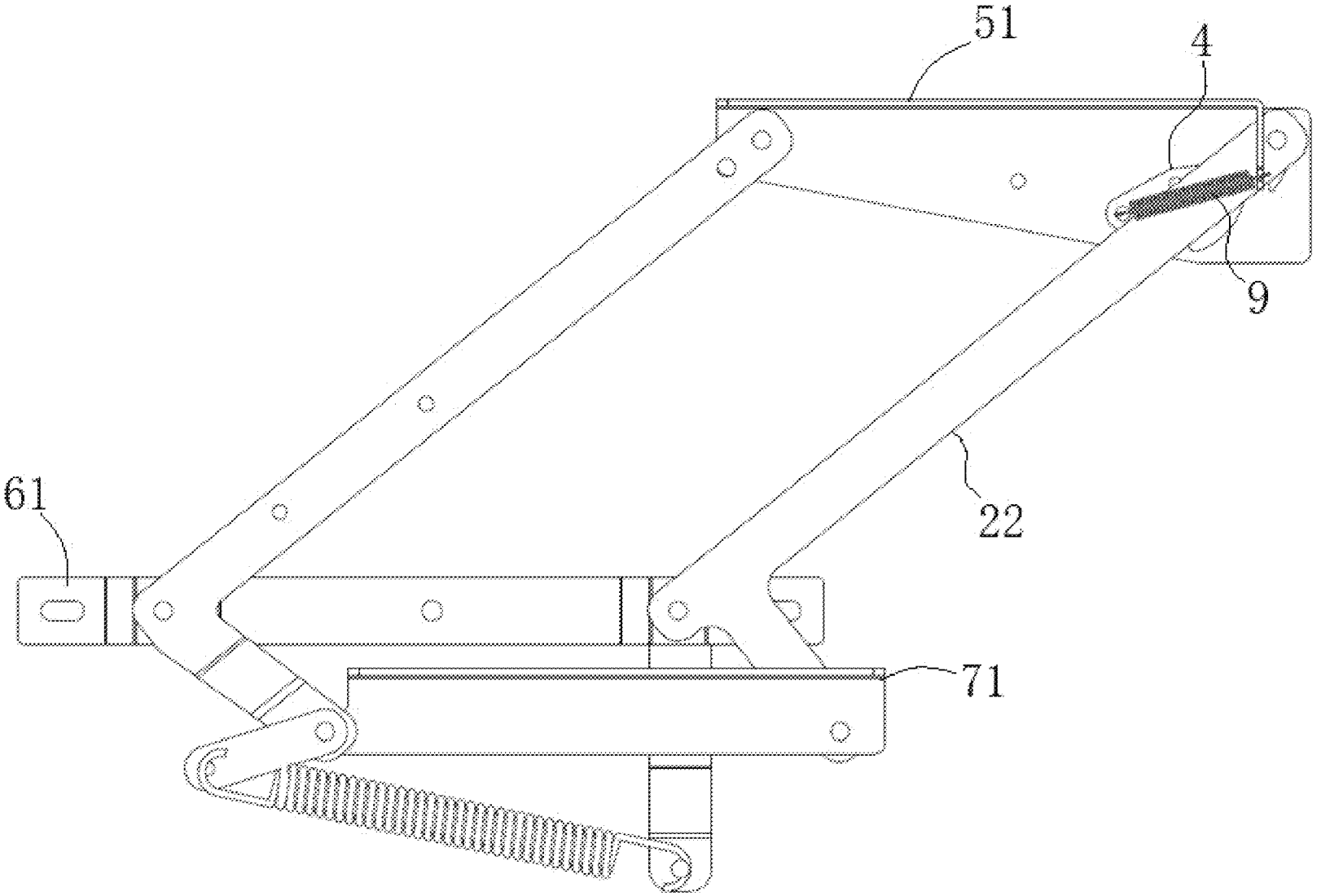
FIG. 8 is a schematic diagram of the self-locking mechanism in a storage process according to the present disclosure.
Figure 9:
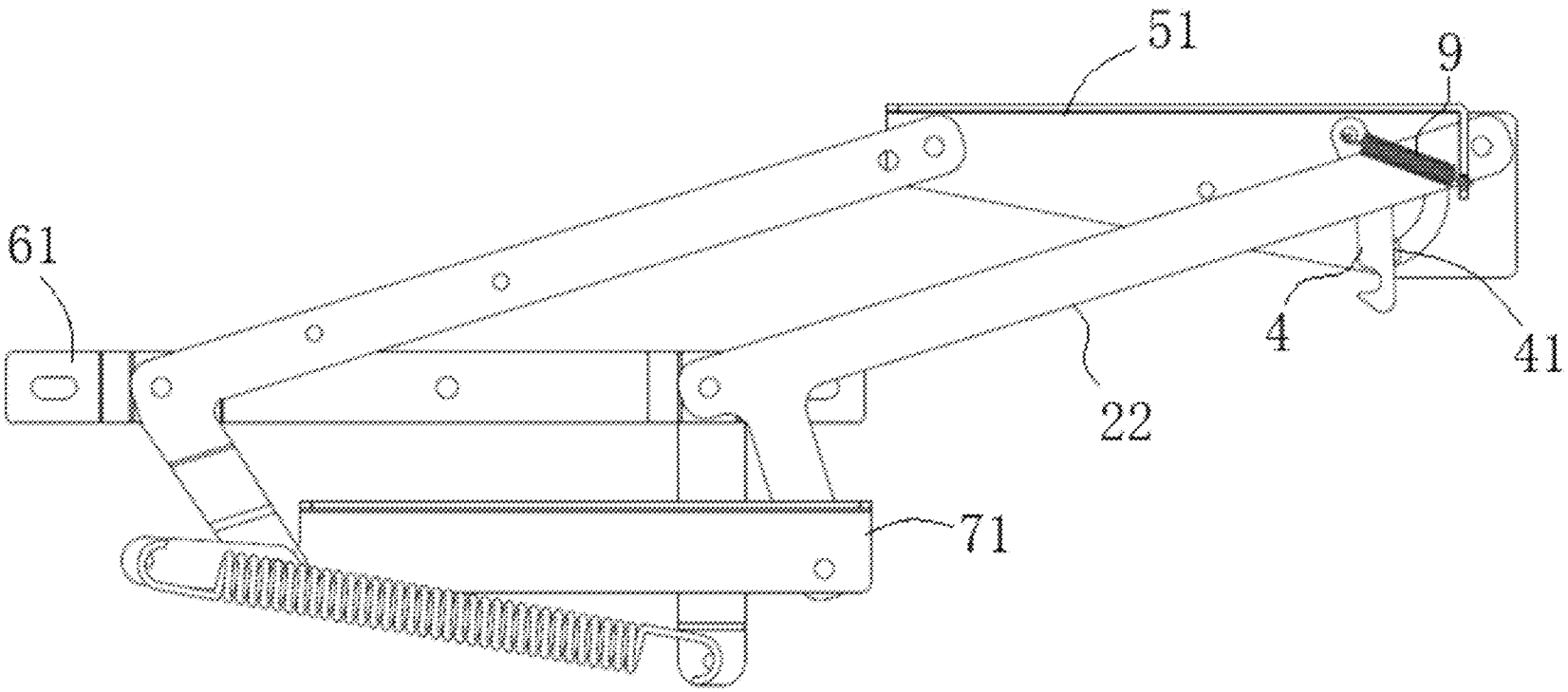
FIG. 9 is a schematic diagram of the self-locking mechanism in a stored state according to the present disclosure.

FIG. 8 is a schematic diagram of the self-locking mechanism in a storage process according to the present disclosure, and FIG. 7 is a schematic diagram of the self-locking mechanism in the stored state. As shown in FIGS. 8, 9, and 4 to 7, the self-locking mechanism 1 for a folding sofa further includes second elastic member 9. One end of the second elastic member 9 is connected to the first end 401 of the limit rotating rod 4, and the other end of the second elastic member 9 is connected to the first connecting member 51. The other end of the second elastic member 9 is further connected to one end of the first connecting member 51 close to the arc-shaped groove 511, as shown in FIG. 4, and the second elastic member 9 is connected to a right end of the first connecting member 51. When the rotating tab 42 slides upward along the arc-shaped groove 511 to abut against an upper end of the arc-shaped groove 511, the second elastic member 9 prevents the limit rotating rod 4 from rotating due to gravity thereof. When the front sofa cushion 5 is folded and stored on the rear sofa cushion 7 through the linkage of the link assembly 2, the second link 22 pushes the rotating tab 42, causing the rotating tab 42 to slide downward along the arc-shaped groove 511, and the second elastic member 9 drives the limit rotating rod 4 to reset.

As shown in FIGS. 1 to 3, in this implementation, a side of the front sofa cushion 5 away from the rear sofa cushion 7 is provided with support plate 52. When the front sofa cushion 5 is folded and stored on the rear sofa cushion 7, the support plate 52 is fitted to an outer surface of the sofa frame 6. When the front sofa cushion 5 is unfolded at one side of the sofa cushion 7, the support plate 52 is supported on a ground to support the front sofa cushion 5.

In summary, the present disclosure provides a self-locking mechanism for a folding sofa. The front sofa cushion is folded and stored on the rear sofa cushion inside the sofa frame or unfolded at one side of the rear sofa cushion through the linkage of the link assembly, such that the folding sofa can be unfolded or folded in one step, with simple operation and small structural volume, reducing logistics costs. After the front sofa cushion is unfolded, the limit rotating rod cooperates with the self-locking rivet to prevent the link assembly from rotating, thereby locking the folding sofa. In this way, the front sofa cushion cannot be folded due to excessive load of the rear sofa cushion, greatly improving product safety. In addition, in the present disclosure, there is no gap in an exposed part of an iron frame mechanism of the self-locking mechanism for a folding sofa, avoiding various unexpected pinch accidents.

It should be noted that terms "including", "comprising" or any other variants thereof are intended to cover non-exclusive inclusion such that a process, method, article, or apparatus including a series of elements includes not only those elements but also other elements not explicitly listed, or elements inherent to such a process, method, article, or apparatus. Without further limitation, an element qualified by the phrase "including a . . . " does not exclude the presence of an additional identical element in the process, method, article, or apparatus including the element.

The embodiments of the present disclosure have been described above with reference to the drawings, but the present disclosure is not limited to the foregoing specific embodiments. The foregoing specific embodiments are only illustrative and not restrictive. Under the inspiration of the present disclosure, those of ordinary skill in the art can make many improvements without departing from the purpose of the present disclosure and the protection scope defined by the claims, and these improvements shall fall within the protection scope of the present disclosure.

What is claimed is:

1. A self-locking mechanism for a folding sofa, comprising:

a link assembly, comprising a first end pivoted to a front sofa cushion and a second end pivoted to a fixed base frame of a sofa frame, wherein the front sofa cushion is folded and stored on a rear sofa cushion inside the sofa frame or unfolded at a side of the rear sofa cushion through linkage of the link assembly;

a self-locking rivet, located on the link assembly; and a limit rotating rod, movably provided on the front sofa cushion, wherein one end of the limit rotating rod is provided with an arc-shaped hook corresponding to the self-locking rivet; and when the front sofa cushion is unfolded at the side of the rear sofa cushion, the link assembly drives the self-locking rivet to slide into the arc-shaped hook through an opening of the arc-shaped hook, and the limit rotating rod cooperates with the self-locking rivet to prevent the link assembly from rotating;

wherein the link assembly comprises:

a first link, provided with a first link segment, wherein the first link segment comprises a first end pivoted to a lower side of the front sofa cushion and a second end pivoted to the fixed base frame; and a second link, provided with a second link segment and a third link segment located at a first end of the second link segment, wherein the second link segment corresponds to and is parallel to the first link segment; a second end of the second link segment is pivoted to the lower side of the front sofa cushion; a connecting end between the second link segment and the third link segment is pivoted to the fixed base frame; the third link segment is pivoted to a lower side of the rear sofa cushion; and when the front sofa cushion is folded and stored on the rear sofa cushion or unfolded at the side of the rear sofa cushion through the linkage of the link assembly, the third link segment drives the rear sofa cushion to fall or rise;

wherein the lower side of the front sofa cushion is provided with a first connecting member; the first link segment and the second link segment are pivoted to the first connecting member; the lower side of the rear sofa cushion is provided with a second connecting member; and the third link segment is pivoted to the second connecting member;

wherein the limit rotating rod is provided with a first end, a second end opposite to the first end, and a middle segment located between the first end and the second end; the arc-shaped hook is located at the first end; the middle segment is pivoted to the first connecting member; and the limit rotating rod is configured to rotate around a pivot position of the limit rotating rod to slide the self-locking rivet out of the arc-shaped hook.

2. The self-locking mechanism for the folding sofa according to claim 1, further comprising a first elastic member, wherein a first end of the first elastic member is pivoted to the fixed base frame; the first link is further provided with a fourth link segment located at a pivot end of the first link segment pivoted to the fixed base frame; the fourth link segment corresponds to and is parallel to the third link segment; a second end of the first elastic member is pivoted to the fourth link segment; and when the front sofa cushion is unfolded at the side of the rear sofa cushion, the first elastic member is in an extended state.

3. The self-locking mechanism for the folding sofa according to claim 1, wherein the first connecting member is provided with an arc-shaped groove corresponding to the limit rotating rod; a side of the limit rotating rod is provided with a rotating tab; the rotating tab is located inside the arc-shaped groove; when the front sofa cushion is unfolded at the side of the rear sofa cushion through the link assembly, the rotating tab abuts against a lower end of the arc-shaped groove; and when the rotating tab slides upward along the arc-shaped groove, the rotating tab drives the limit rotating rod to rotate around the pivot position of the limit rotating rod, causing the self-locking rivet to slide out of the arc-shaped hook.

4. The self-locking mechanism for the folding sofa according to claim 3, further comprising a second elastic member, wherein the second elastic member comprises a first end connected to the first end of the limit rotating rod and a second end connected to the first connecting member; and when the rotating tab slides upward along the arc-shaped groove to abut against an upper end of the arc-shaped groove, the second elastic member prevents the limit rotating rod from rotating due to gravity of the limit rotating rod.

5. The self-locking mechanism for the folding sofa according to claim 4, wherein when the front sofa cushion is folded and stored on the rear sofa cushion through the linkage of the link assembly, the second link pushes the rotating tab, causing the rotating tab to slide downward along the arc-shaped groove, and the second elastic member drives the limit rotating rod to reset.

6. The self-locking mechanism for the folding sofa according to claim 4, wherein the limit rotating rod is located between the first link segment and the second link segment; the arc-shaped groove is located at a side of the limit rotating rod adjacent to the second link segment; an arc center of the arc-shaped groove faces the pivot position of the limit rotating rod; and the second elastic member is connected to an end of the first connecting member adjacent to the arc-shaped groove.

7. The self-locking mechanism for the folding sofa according to claim 1, wherein a side of the front sofa cushion away from the rear sofa cushion is provided with a support plate; and when the front sofa cushion is folded and stored on the rear sofa cushion, the support plate is fitted to an outer surface of the sofa frame.

* * * * *